United States Patent [19]

Heim et al.

[11] Patent Number: 4,728,031

[45] Date of Patent: Mar. 1, 1988

[54] APPARATUS FOR FASTENING RAILS TO RAILROAD TIES

[75] Inventors: Armin Heim, Kreuzlingen, Switzerland; Johannes Horn, Wiesbaden; Karl-H. Schwiede, Daisendorf, both of Fed. Rep. of Germany

[73] Assignees: Schwihag, Gesellschaft fur Eisenbahnoberbau mbH, Tagerwilen, Switzerland; Firma Karl Richtberg KG, Rein, Fed. Rep. of Germany

[21] Appl. No.: 206,717

[22] Filed: Jun. 1, 1981

[51] Int. Cl.[4] ..... E01B 9/40

[52] U.S. Cl. ..... 238/303; 238/302; 238/284; 238/382; 411/155; 211/86

[58] Field of Search ..... 238/304, 307, 287, 289, 238/291, 292, 306, 349, 297, 298, 301, 302, 283, 284, 382, 303; 411/154, 155, 156, 159; 248/205.1; 211/86

[56] References Cited

U.S. PATENT DOCUMENTS

| | | | |
|---|---|---|---|
| 364,432 | 6/1887 | Olmstead | 238/302 |
| 763,153 | 6/1904 | Butterfield | 238/304 |
| 987,988 | 3/1911 | Holden | 238/297 |
| 1,011,208 | 12/1911 | Kendrick | 238/349 |
| 1,103,317 | 7/1914 | Rorke | 238/302 |
| 1,361,750 | 12/1920 | Clark | 238/288 |
| 1,603,430 | 10/1926 | Vaughan et al. | 238/298 |
| 2,085,970 | 7/1937 | Greene | 238/349 |
| 2,169,408 | 8/1939 | De Vellier | 238/372 |

FOREIGN PATENT DOCUMENTS

| | | | |
|---|---|---|---|
| 105110 | 4/1898 | Fed. Rep. of Germany . | |
| 576626 | 4/1933 | Fed. Rep. of Germany | 238/284 |
| 1021003 | 12/1957 | Fed. Rep. of Germany . | |
| 2912451 | 10/1980 | Fed. Rep. of Germany . | |
| 927880 | 11/1984 | U.S.S.R. | 238/306 |

*Primary Examiner*—Robert B. Reeves
*Assistant Examiner*—Glenn Foster
*Attorney, Agent, or Firm*—Stevens, Davis, Miller & Mosher

[57] ABSTRACT

Apparatus for fastening rails on ties of a railroad comprising four rail screws for flushly mounting an abutment face of a bedplate against the upper surface of the tie and a pre-stressed, elastically deformable bedplate having a convex curved abutment face for frictionally engaging the upper surface of the tie and for applying a spring force against the rail screws when the rail screws are used to brace the curved abutment face flush against the tie.

13 Claims, 12 Drawing Figures

APPARATUS FOR FASTENING RAILS TO RAILROAD TIES

BACKGROUND OF THE INVENTION

Figure 1:
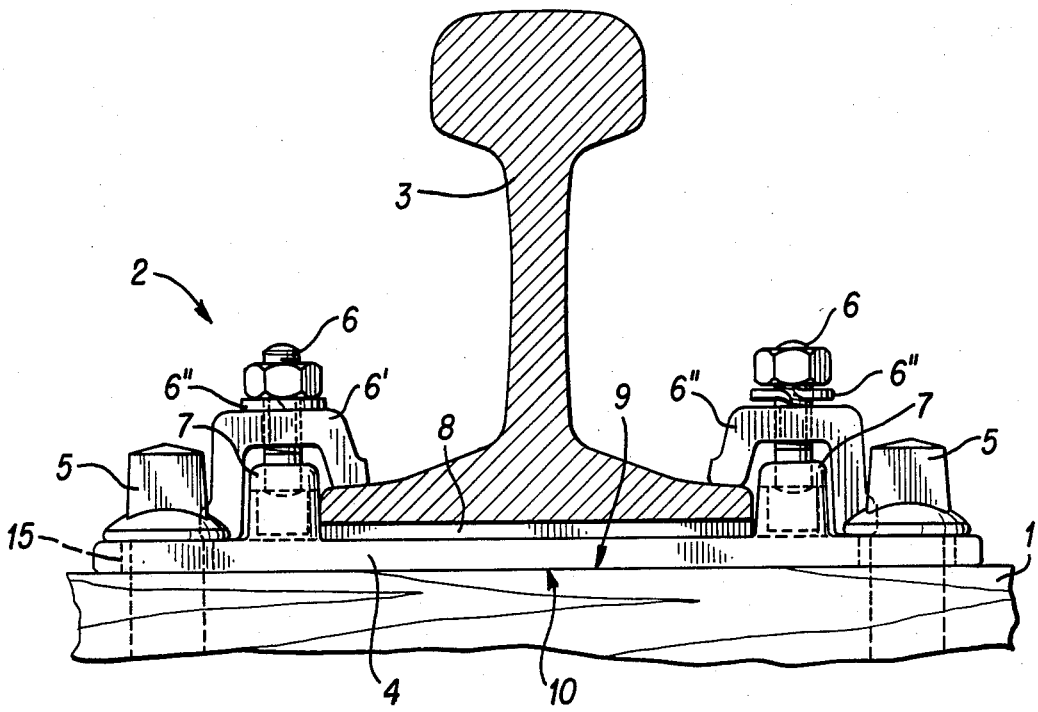

In rail fastenings for fastening rails to wooden ties, the bedplates or ribbed plates, or the ribbed support plates, serve to transfer forces from the rail to the tie or the rail support point and simultaneously to establish the position of the two rails relative to each other such that the required gage for the wheelsets of the trains are maintained at each point of the track.

The bedplates or ribbed plates, or ribbed support plates, thus form a particularly important component of the rail fastening, since horizontal forces are transmited by them from the rails to the rail support points. This means that the bedplates or ribbed plates, or the ribbed support plates, can only be secured against displacement relative to the tie surface or to the abutment surface of the rail support point, and in fact particularly in the direction transverse to the long axis of the track, in that the abutment surfaces of the bedplates or ribbed plates, or of the ribbed support plates, are pressed as a unit, with considerable surface pressure, onto the tie surface or the rail support point by the rail screws or the like, and thus the free horizontal forces acting on the bedplates or ribbed plates, or on the ribbed support plates, can be transmitted as frictional forces, without displacement, to the transverse ties or to the rail support point.

These requirements already existed since the introduction of rail fastenings, the bedplates or ribbed plates, or the ribbed support plates, of which are fastened by rail screws to wooden ties. However, they could not be satisfactorily fullfilled up to now. It has been found in practice that most bedplates or ribbed plates, or ribbed support plates, attain no, or only a small and thus insufficient, frictional contact in the clamped state with the transverse tie or the rail support point, between their abutment face and the rail support point abutment face; and furthermore, this frictional contact becomes increasingly smaller as the period of use of the track equipment increases. It had to be established that in practice a force-transmitting frictional contact between the bedplates or ribbed plates, or ribbed support plates, and the rail support point abutment face, is only attained, with a newly built-in rail support point, in the immediate neighborhood of the rail screw or the like, whether or not this is braced with a spring ring.

This bracing between the bedplates or ribbed plates or ribbed support plates and the tie surface or rail support point abutment face, still readily effective initially, however diminishes considerably even after a short service period, and in fact since plastic deformation of the tie surface occurs due to the high bracing forces. Besides the displacement of the bedplates or ribbed plates, or ribbed support plates, occurring by the action of horizontal forces, with the resulting change in gage, there results the further disadvantage that the walls of the holes in the bedplate or ribbed plate, or ribbed support plates, abut against the shafts of the rail screws and exert bending stresses on the rail screws because of the load resulting from trains on the track, so that the permanent fixed seating of them in the ties is impaired.

Since loosening of the bedplates or ribbed plates, or ribbed support plates, entails a reduction of the overall stability of the track, double or threefold stressing spring washers are also often provided between this and the head of the rail screw. Since, however, such spring washers have not only a small spring path, but also apart from this an unfavorably progressive spring characteristic, their effectiveness is often impaired even by comparatively small plastic deformation of the tie surface. Such spring washers also often break, because of their unfavorable spring characteristic.

It has also been found that when the known rail fastenings are used in combination with wooden ties a very high surface pressure arises about the rail screws, because of which there occurs a plastic-elastic deformation of the tie surface. The disadvantage further results from this that the bedplates or ribbed plates, or ribbed support plates, curve upward in their middle region, and the bedplates or ribbed plates thus lift from the tie surface in the region of the rail.

When traffic passes over the bedplates or ribbed plates, these are transiently pressed down in the curved region—so-called pumping. This pumping then naturally leads to a gradual mechanical destruction of the tie surface. Research has also been undertaken to prevent this so-called pumping of the bedplates or ribbed plates, in fact, by making the bedplates or ribbed plates laid in the region of switches 20 mm thick instead of 16 mm. However, the undesired pumping effect could only be reduced to a small extent by this costly measure.

The most commonly used rail fastening, K-type, initially effects a substantially rigid connection to the bedplate or ribbed plate by the strong clamping of the rail foot by means of hook bolts, clamp plates and spring rings. The so-called lifting wave of the rail which inevitably occurs when the track is used is thus transmitted undamped in the longitudinal direction of the track to the bedplate or ribbed plate. Torsional stresses of the bedplates or ribbed plates and of the transverse ties furthermore result from this in the direction of travel, with the result that plastic deformations of the tie surface occur and again lead to a loosening of the fastening to the transverse tie.

Attempts have in fact been made to remedy this disadvantage by substituting clamp clips or clamps for hook bolts, clamp plates and spring rings. The torsional stresses could in fact be reduced slightly by this means. However, there also simultaneously resulted an undesired reduction of the resistance to through-thrust and twisting.

SUMMARY OF THE INVENTION

The aim of the invention is to eliminate all the disadvantages of apparatuses of this type for rail fastening to ties or other rail support points, to the greatest possible extent. Therefore the object of the invention is to produce a fastening apparatus for rails in railroad permanent way which not only ensures a permanent, non-positive fixing of the bedplates or ribbed plates on the rail support point abutment face, but also makes possible a reduction of the dimensions for the bedplates or ribbed plates, but nevertheless fullfulls its function, free from maintenance and disturbance, at least over the usual lifetime of 40–50 years with wooden ties.

The solution of this complex object is ensured with surprising ease, according to the invention, by a fastening apparatus with a shape which is curved both inwards and downwards from its bounding edges and which may be braced flush to the tie surface with elastic deformation.

With the use of these measures, there occurs in fact still a small—basically unavoidable—elastic deformation of the abutment face of the rail support point; however, by the intrinsic elasticity appearing as a restoring action and inherent in the bedplate or ribbed plate, or in the ribbed support plate, a non-positive frictional connection is even maintained between these and the tie surface or the rail support point abutment surface, when corrosive wear sets in between the bedplate or ribbed plate or ribbed support plate and the head of the tie screw. Hence tightening-up of the tie screw is practically unnecessary during the whole lifetime of the transverse tie, which in particular consists of wood.

According to requirements, the bedplates or ribbed plates or ribbed support plates can be curved linearly, two-dimensionally, or even in three dimensions, beforehand, and then permanently prestressed; the direction of the elasticity provided can lie transversely, longitudinally, or even diagonally.

The bedplates, ribbed plates, or ribbed support plates used in connection with an apparatus according to the invention for rail fastening to rail support points, in particular wooden ties in railroad permanent way, can be produced from rolled profile and/or as drop-forged parts.

It can prove to be particularly advantageous, when the bedplates, ribbed plates or ribbed support plates are first produced as flat-rolled or pressed profiles and then brought to the curved initial shape by cold deformation in a die. The bedplates, ribbed plates or ribbed support plates may also be made as cast parts or from welded construction.

The abutment faces of the bedplates, ribbed plates or ribbed support plates of the invention may also have flutings, embossings or dimples.

Further features and advantages of apparatuses for rail fastening to rail support points, in particular, wooden ties, in railroad permanent way, according to the invention, are illustrated below by embodiments, by means of drawings, in which there are shown:

FIG. 1, in cross section, a rail UIC 60 with the associated fastening, the hook bolt serving as the fastening element not being in final position in the right-hand half, but finally positioned in the left-hand half.

Figure 2:
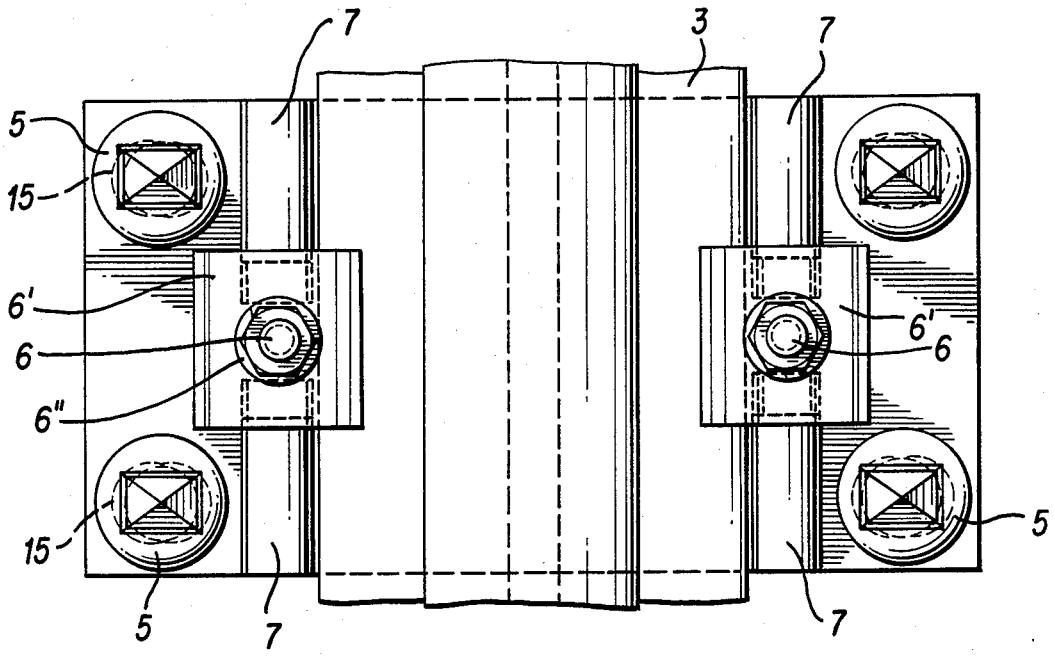
Figure 3:
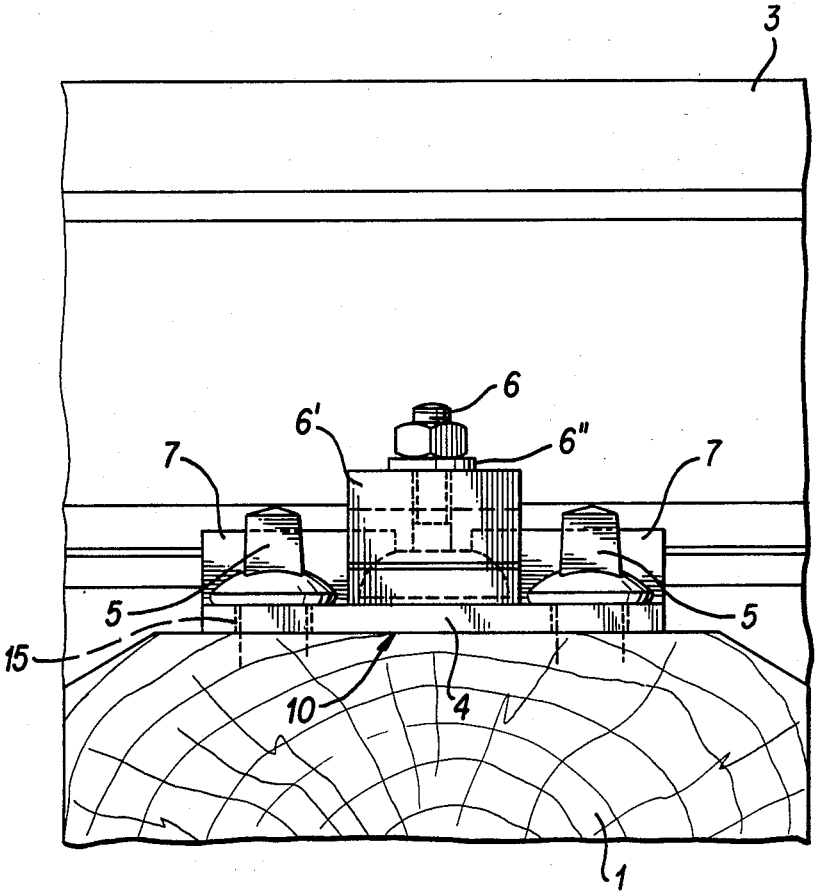
Figure 4:
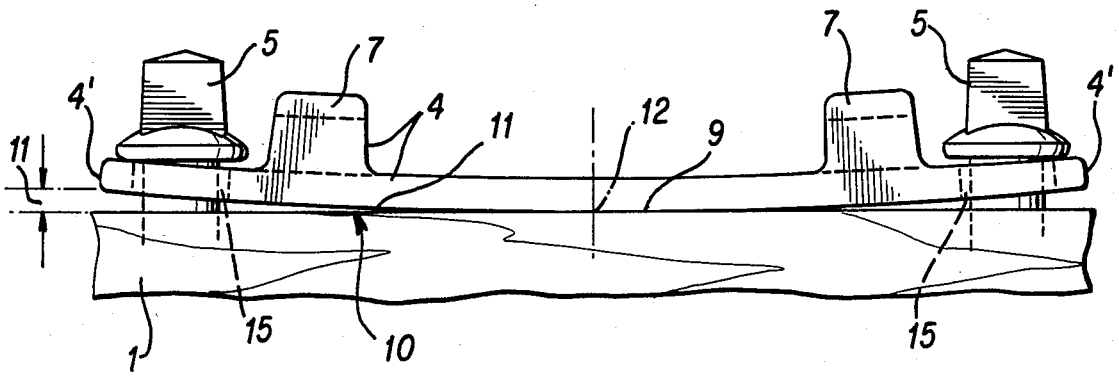
Figure 5:
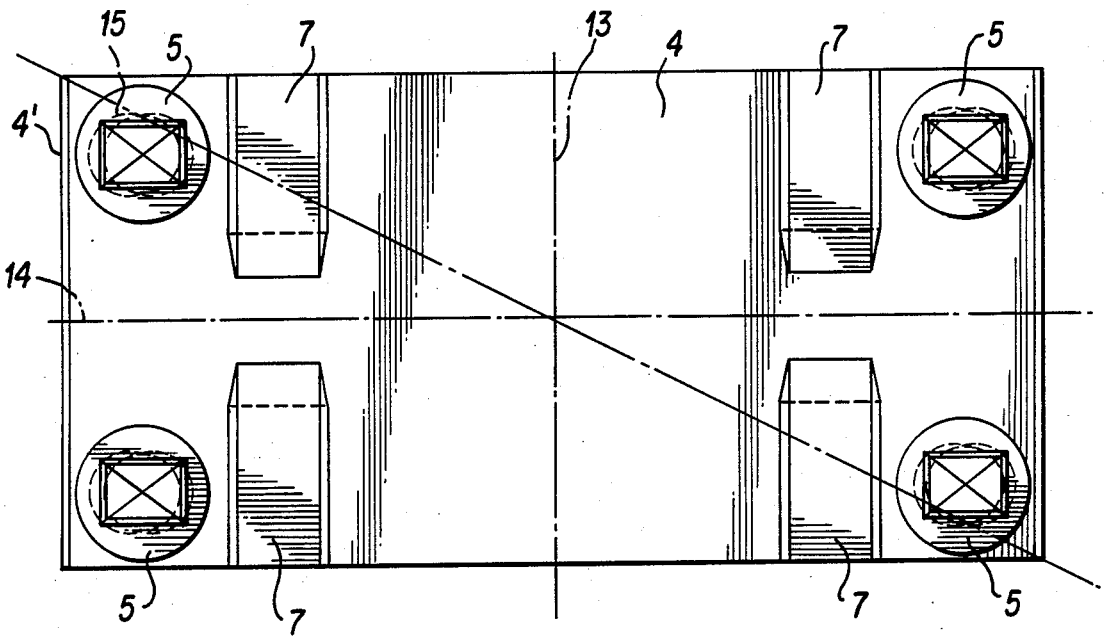
Figure 6:
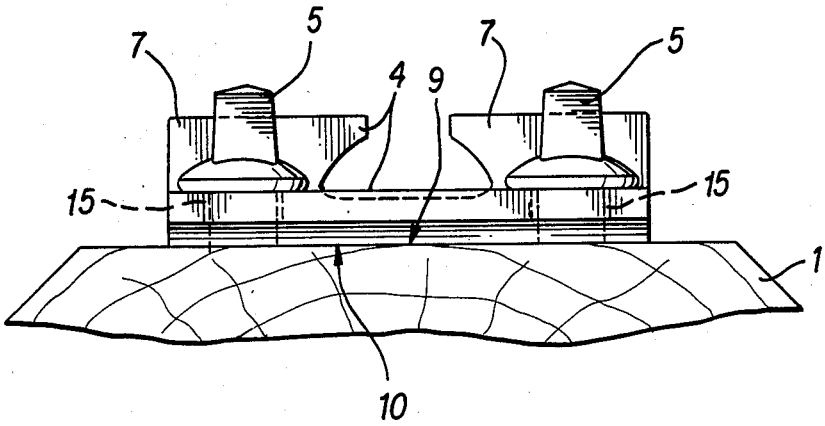

FIG. 2, the apparatus for rail fastening according to FIG. 1, in plan view;

FIG. 3 reproduces the rail fastening of FIGS. 1 and 2 in side view;

FIG. 4, a bedplate or ribbed plate used in the apparatus for rail fastening according to FIGS. 1 to 3, in the curved, unstressed state and in face view, while FIG. 5 reproduces a plan view and FIG. 6 a side view of this bedplate or ribbed plate.

Figure 7:
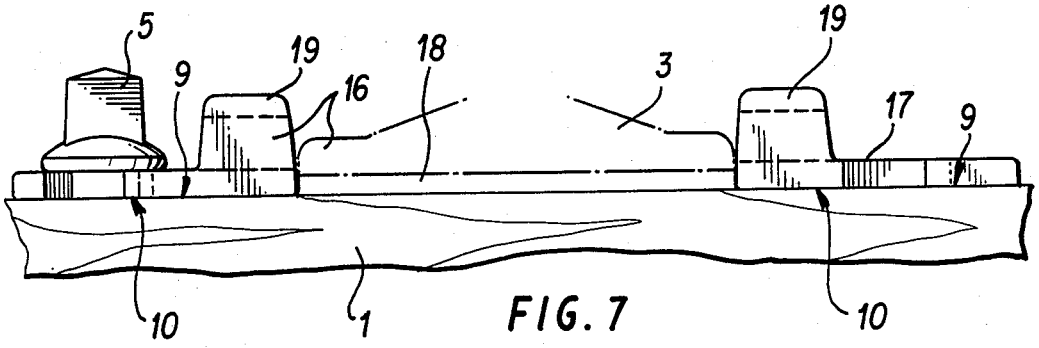
Figure 8:
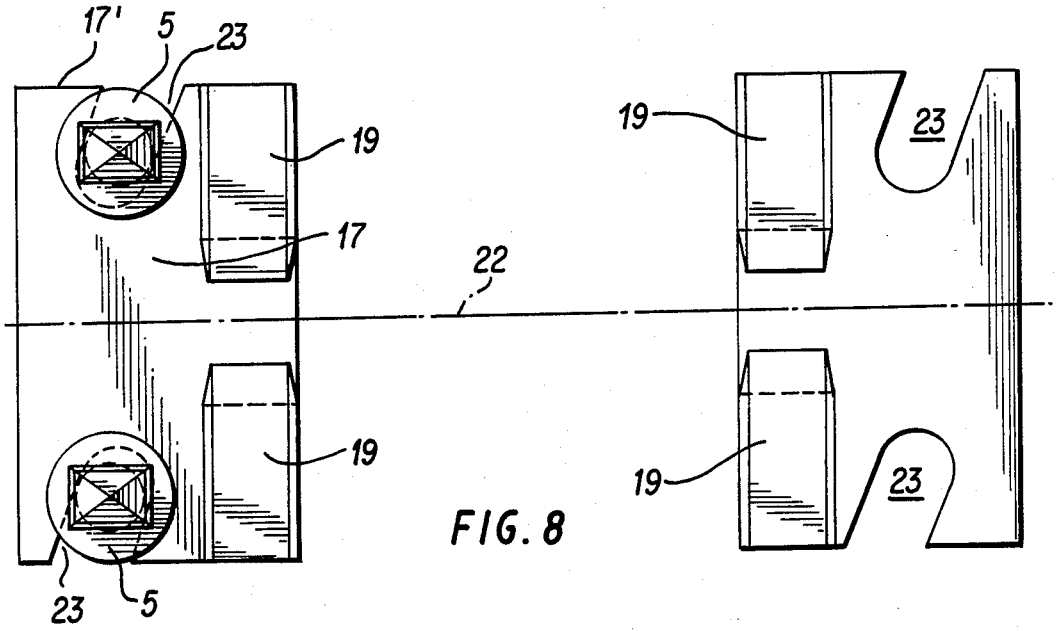
Figure 9:
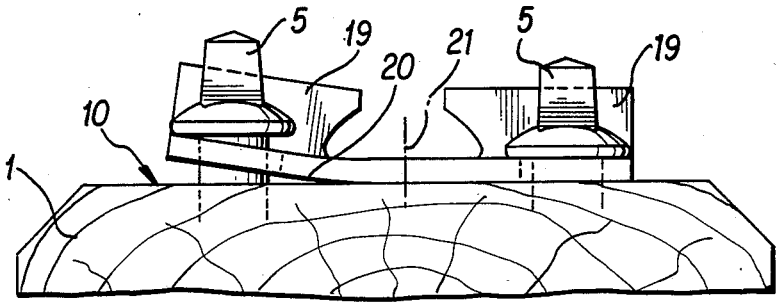
Figure 10:
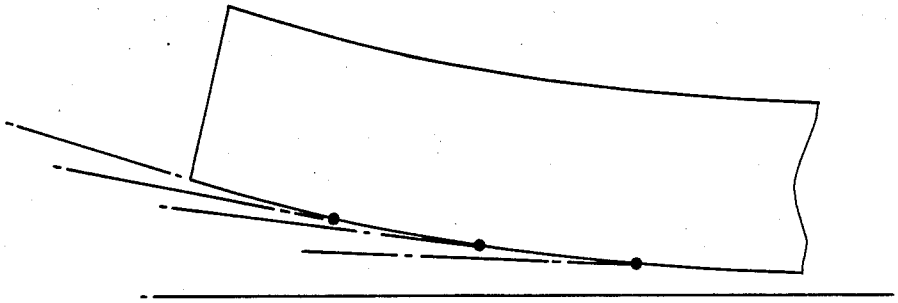
Figure 11:
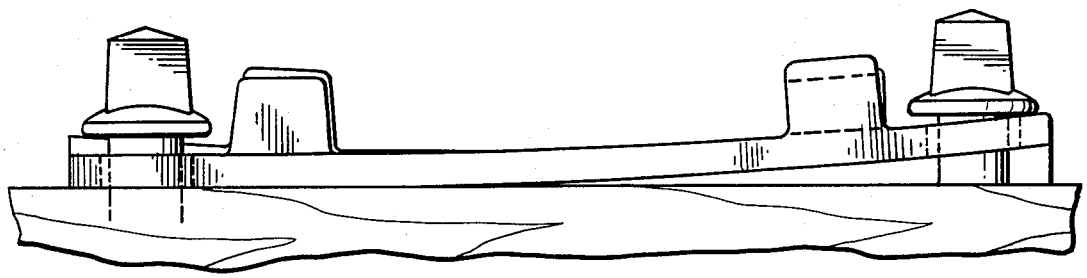
Figure 12:
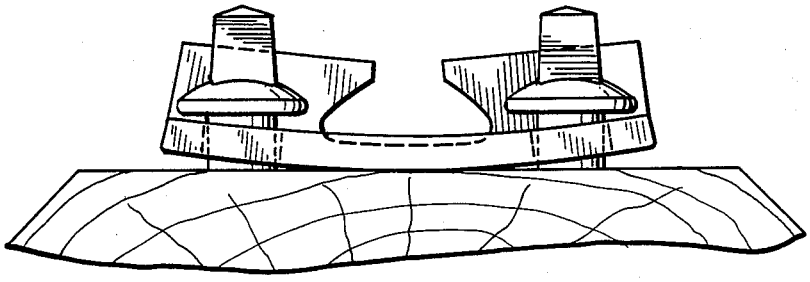

Finally, another form of embodiment of an apparatus for fastening rails to cross ties, provided with ribbed support plates instead of bedplates or ribbed plates, is shown in FIG. 7 seen in the longitudinal direction, FIG. 8, in plan view, and FIG. 9, in side view.

In railroad permanent way, the individual track equipment is very often laid by means of cross-ties 1 on the ballast bed. As cross-ties 1, impregnated wooden ties with calibrated tie ends are extensively laid in the ballast bed. Beech, oak, or even pine, and tropical woods such as yang-teak, are used as tie woods.

The cross-ties 1, laid at given distances from one another, are connected, secure against tilting, to the rail 3 by means of the rail fastening 2, to give a comparatively stiff track frame. Each of the rail fastenings 2 is composed of a bedplate or ribbed plate 4, several, e.g., four, rail screws 5 connecting this to the cross-tie 1, and also clamping elements which on the one hand can be coupled to the bedplate or ribbed plate 4 and also on the other hand are applied to the rail foot, they are formed, for example, by hook bolts 6, clamp plates 6', and spring rings 6'', as shown in FIGS. 1 through 3. Instead of hook bolts, clamp plates and tension rings 6, it is of course also possible to use clamp clips or gripping clamps as clamping elements, brought into functional connection with the rail foot.

The bottom side of the rail foot is supported here between the two ribs 7 or the bedplate or ribbed plate 4, not directly on their upper sides. What is more, an intermediate position 8 is inserted there.

The hook bolt 6 used as clamping element is shown in the left-hand half of FIG. 1 in the finally mounted state; the clamping plate 6' abuts the rail foot as a pressure element, while the prestress is produced by the nut and spring ring 6'' cooperating with the hook bolt.

The right-hand half of FIG. 1 shows, in contrast, the hook bolt 6 with nut, clamp plate 6' and spring ring 6'' in the not yet finally mounted state.

It is particularly important for the effectiveness of the rail fastening 2 that the abutment face 9 of the ribbed plate 4 is held in contact, as a unit and permanently, with the tie surface 10. To attain this objective, the bedplate or ribbed plate 4 is used, as can be seen from FIGS. 4 and 6, with an initial shape which is curved inwards and downwards at least from two opposed bounding edges, here the two longitudinal bounding edges 4'.

In the example of an embodiment of the bedplate or ribbed plate 4 according to FIGS. 4 through 6, the curvature 11 runs transversely, and in fact such that the crown 12 of the curvature coincides with the longitudinal midline 13 of the bedplate or ribbed plate 4.

However, in other cases the curvature 11 can also extend parallel to the longitudinal direction of the bedplate or ribbed plate 4, shaped such that the summit of the curvature 12 then coincides with the transverse midline 14.

Finally, it is also conceivable, however, that the curvature 12 is allowed to run diagonally of the bedplate or ribbed plate 4, such that it preferably forms a spherical surface which in a way has only one vertex point in the region of intersection of the longitudinal midline 13 and transverse midline 14.

The curvature for the abutment faces 9 of the bedplate or ribbed plate 4 can run in a curve, e.g., a circular or elliptical arc or other appropriate geometrical curve. It can, however, be delimited by successive straight lines joined at given angles, and/or by two-dimensional curves.

The bedplate or ribbed plates 4 according to FIGS. 4 through 6 can be produced either as rolled profiles or even as drop-forged, cast, or welded parts. It can be particularly convenient for these bedplates or ribbed plates 4 to be first rolled or pressed flat in a preliminary production step and then be given the curvature 11 by cold deformation in the die.

It is important here that the bedplates or ribbed plates 4 having the curvature 11 are elastically braced by means of the four rail screws 5 or the like, each passing through a hole, in particular an oval hole 15, with relatively large play, and can thus be braced with their whole abutment face 9 frictionally locked against the tie surface 10. By corresponding tightening of the rail screws 5 or the like, a given surface pressure can hence be produced between the abutment face 9 of the bedplate or ribbed plate 4 and the tie surface 10. This is then enlisted for transmission of the horizontal forces acting from the rail 3 on the bedplate or ribbed plate 4. The greater the elastic path 11 to be traveled of the bracing (FIG. 4), the greater is also the surface pressure which can be obtained, depending in fact on quality of material, plate dimensioning, and shape of curvature. A curved shape has been found to be optimum for the shape of the curvature 11 here, based on trials. Of course, a given polygonal approximation with different vertex angles, or a geometrical curve shape with quadratic or cubic or higher-order elements can also be used for obtaining an optimum surface pressure. Finally, it is also even possible to form the curvature 11 by coupling straight lines of greater or lesser length with two-dimensional curves and intermediate straight lines. Different curvatures of the upper and lower sides, and also of the inner and outer regions, are also conceivable.

It is expected that by use of bedplates or ribbed plates of such shapes as the important functional part of apparatuses for rail fastening, the elastic bracing of the bedplate or ribbed plate 4 to the tie surface 10 and the anchoring stress in the region of the ribs 7 remain maintained in permanent use for the whole lifetime of wooden ties, i.e., about 40 or 50 years, in spite of the wheel load acting statically and dynamically from outside, without the maximum surface and edge pressures exceeding the permissible long-term surface pressures of the types of wood and other materials utilized in ties.

The spring washers up to now used between the rail screws 5 and the bedplates or ribbed plates can be avoided by the construction and bracing of the bedplates or ribbed plates 4 as described. The elastically braced bedplate or ribbed plate 4 fullfills the function of maintaining a frictionally locked connection between itself and the tie surface substantially better than such spring washers. Spring washers have a progressive characteristic which is very small and unfavorable for this purpose. Even at small elastic and plastic deformations, the maintenance of clamping thus decreases rapidly with small elastic and plastic deformations of the tie surface 10. As against this, the pre-curved bedplates have a force/spring path which runs flatter and which approximates a linear course and which is, for the purpose envisaged, greater and hence more favorable.

A constructionally modified form of an apparatus for rail fastening to cross-ties is shown in FIGS. 7 through 9.

Here, instead of a respective single integral bedplate or ribbed plate 4 for forming rail fastenings 16 to cross-ties 1, two so-called ribbed support plates 17 are utilized. The two ribbed support plates 17 are here placed adjacently on the tie surface 10 at a spacing such that the foot of the rail 3 can be set on an intermediate layer 18 in the space remaining free.

The constructional embodiment of the two ribbed support plates 17 is identical. They are solely arranged on each of the rail foot, rotated through 180° relative to each other. The clamping means consisting of hook bolts 6, clamp plates 6' and spring washers 6'' here cooperate with the ribs 19 of each ribbed support plate 17 in the same way as with the embodiment already described of integral bedplate or ribbed plate 4. Clamping yokes or clamp clips can also be used here as clamping means, however.

These ribbed support plates 17 also have an initial shape which is curved, in the unbraced state, inwards and downwards from opposed bounding edges, here the transverse bounding edges 17', as can immediately be seen from FIG. 9; the summit 21 of the curvature coincides with the transverse midline 22 of each ribbed support plate 17.

The rail screws 5 cooperate with the ribbed support plates 17 respectively via the engagement slots 23 which are open towards their transverse bounding edges 17' and also inclined relative to the longitudinal axis of the rail, such that there has also to occur, on a longitudinal displacement of the ribbed support plates 17 relative to the rail screw 5, a component of motion in the transverse direction. Because of this, the ribbed support plates can also be braced in the transverse direction against the rail foot, and also can be established, with a prestress resulting from the curvature 20, permanently frictionally locked against the tie surface 10, as can be seen in the right-hand half of FIG. 9.

In conclusion it should further be mentioned that it is further of great advantage for the abutment face 9 of the bedplate or ribbed plate 4 or of the ribbed support plates 17 to have surface roughenings. These can be formed as flutings, knurling, embossings or dimples, or be produced by sandblasting. These measures not only increase the coefficients of friction, but also give a further mechanical toothing with the tie surface 10.

Adhering of the bedplates or ribbed plates 4, or the ribbed support plates 17, to the tie surface 10 is also possible. This is of particular advantage when softwood ties, e.g. of pine, are used. In this case, however, bedplates or ribbed plates 4, or ribbed support plates 17, should be used with a slightly enlarged abutment face 9. Adhering of the elastically prestressed bedplates or ribbed support plates is particularly useful in support points for ballastless permanent way or for concrete ties. Rail screws 5 should be used, in connection with the bedplates or ribbed plates 4 or ribbed support plates 17 as described above, which have a collar having rounded peripheral edges on the abutment face, so that their penetration into the plate surface is prevented.

SUMMARY OF REFERENCES

1 Cross-tie
2 Rail fastening
3 Rail
4 Bedplate or ribbed plate
5 Rail screw
6 Hook bolt
6' Clamp plate
6'' Clamping ring
7 Ribs
8 Intermediate layer
9 Abutment face
10 Tie surface
11 Curvature
12 Summit of curvature
13 Longitudinal midline
14 Transverse midline
15 Hole
16 Rail fastening
17 Ribbed support plate
18 Intermediate layer
19 Ribs
20 Curvature 21 Summit of curvature 22 Transverse midline 23 Engagement slot

We claim:

1. Apparatus for fastening rails on ties in railroad permanent way, comprising:

(a) at least two rail screws for flushly mounting an abutment face of a bedplate against the upper surface of a tie, and (b) a pre-stressed, elastically deformable bedplate having a convex curved abutment face for frictionally engaging said upper surface of a tie, for applying a spring force against said rail screws when said rail screws are used to brace said curved abutment face flush against said tie and for preventing relative movement between said bedplated and tie.

2. The apparatus defined in claim 1 wherein the summit of the curvature of said curved abutment face is located in the center of said face.

3. The apparatus defined in claim 2 wherein said bedplate is elongated, and said curvature runs parallel to the longitudinal axis of said bedplate.

4. The apparatus defined in claim 2 wherein said bedplate is elongated, and said curvature runs transverse to the longitudinal axis of said bedplate.

5. The apparatus defined in claim 2 wherein said bedplate is elongated, and said curvature runs diagonally to the longitudinal axis of said bedplate.

6. The apparatus defined in claim 2, wherein said curve approximates a circular arc.

7. The apparatus defined in claim 2, wherein said curve approximates an elliptical arc.

8. The apparatus defined in claim 2, wherein said curve is comprised of at least one succession of straight lines at mutual angles.

9. The apparatus defined in claim 2, wherein said curved abutment face of said bedplate is formed by cold deformation in a die.

10. The apparatus defined in claim 2, wherein said curve abutment face is formed by drop forging.

11. The apparatus defined in claim 2, wherein said curved abutment face is formed by a steel casting.

12. The apparatus defined in any one of claims 1–11, wherein said curved abutment face is roughened to enhance the frictional contact between said bedplate and said tie.

13. The apparatus ddefined in claim 1, wherein said bedplate has two opposing ribs.

* * * * *